US008297189B2

(12) United States Patent
Hoffmann et al.

(10) Patent No.: US 8,297,189 B2
(45) Date of Patent: Oct. 30, 2012

(54) FIRING DEVICE

(75) Inventors: Wolfgang Hoffmann, Velbert (DE); Wolfgang Scherge, Hermannsburg (DE); Mathias Lengnick, Lindwedel (DE); Holger Brase, Bergen (DE); Stefan Kell, Walsrode (DE); Torsten Niemeyer, Lachendorf (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 34 days.

(21) Appl. No.: 12/619,543

(22) Filed: Nov. 16, 2009

(65) Prior Publication Data

US 2010/0147178 A1 Jun. 17, 2010

(30) Foreign Application Priority Data

Nov. 17, 2008 (DE) ..... 10 2008 057 769

(51) Int. Cl.
*F42B 99/00* (2006.01)

(52) U.S. Cl. ..... 102/293; 102/275.11; 102/275.9

(58) Field of Classification Search ..... 102/499, 102/275.11, 202.1, 473, 481, 275.9, 500
See application file for complete search history.

(56) References Cited

U.S. PATENT DOCUMENTS

| | | | | |
|---|---|---|---|---|
| 3,919,941 | A * | 11/1975 | Breed et al. | 102/250 |
| 4,014,264 | A * | 3/1977 | Bendler et al. | 102/202.6 |
| 4,078,497 | A * | 3/1978 | Castelli | 102/228 |
| 4,690,057 | A * | 9/1987 | Carlsson | 102/266 |
| 4,911,058 | A * | 3/1990 | Andersson et al. | 102/202.1 |
| 7,430,963 | B2 * | 10/2008 | Hennings et al. | 102/202.1 |
| 7,549,374 | B2 * | 6/2009 | Schwantes et al. | 102/275.9 |
| 7,552,682 | B2 * | 6/2009 | Schwantes et al. | 102/275.9 |
| 7,802,518 | B2 * | 9/2010 | Schwantes et al. | 102/275.9 |
| 7,814,834 | B2 * | 10/2010 | Schwantes et al. | 102/275.9 |
| 2006/0016360 | A1 | 1/2006 | Eches et al. | |
| 2007/0051268 | A1 * | 3/2007 | Bissig | 102/476 |
| 2008/0148984 | A1 * | 6/2008 | Schwantes et al. | 102/215 |
| 2008/0148985 | A1 * | 6/2008 | Schwantes et al. | 102/501 |
| 2009/0211481 | A1 * | 8/2009 | Schwantes et al. | 102/275.12 |

FOREIGN PATENT DOCUMENTS

| | | | |
|---|---|---|---|
| DE | 698 14 022 | T2 | 4/2004 |
| DE | 60 2004 001 496 | T2 | 6/2007 |
| EP | 0 928 948 | B1 | 5/2003 |
| EP | 1 521 053 | A1 | 4/2005 |
| FR | 2 050 235 | A1 | 4/1971 |
| GB | 2 006 397 | A | 5/1979 |

OTHER PUBLICATIONS

Abaqus/Explicit 6.11 Data Sheet, 2011.
Abaqus Unified FEA Simulate Realistic Performance with Advanced Multiphysics Solutions, 2011 (brochure).

(Continued)

*Primary Examiner* — Jonathan C Weber
(74) *Attorney, Agent, or Firm* — Griffin & Szipl, P.C.

(57) ABSTRACT

The invention relates to so-called fuze damping in projectiles, in particular, those provided with a built-in firing delay. Thus, a projectile (1) is provided having a rear part (1*a*) and a fuze (2), wherein at least one damping element (7) is inserted between a fuze base (5) and the projectile (1) and/or between a fuze shoulder (6) and a possible threaded ring (4), or similar attachment element. The damping element (7) is in the form of a disc, ring or pot, and is composed of a material with a lower acoustic impedance than the material of the projectile (1).

17 Claims, 1 Drawing Sheet

OTHER PUBLICATIONS

Abaqus/Explicit, at http://www.simulia.com/products/abaqus_explicit.html (2012), (downloaded Jan. 9, 2012, one page).
Abaqus—Wikipedia Article (downloaded Mar. 26, 2012) from http://en.wikipedia.org/wiki/ABAQUS.
Simulia—Wikipedia Article (downloaded Mar. 26, 2012) from http://en.wikipedia.org/wiki/SIMULIA.
Abaqus, Kit—SCC (German), downloaded Mar. 26, 2012 at http://www.scc.kit.edu/produkte/3828.php.
Abaqus, Kit—SCC (English machine translation), downloaded Mar. 26, 2012 through Google Translate.
Navy Aviation Integrated Publishing, Impact and Acceleration/Deceleration Fuzes (downloaded Apr. 9, 2012) from http://navyaviation.tpub.com/14023/css/14023_77.htm.
European search report issued in related application EP09013134 on Apr. 2, 2012.

* cited by examiner

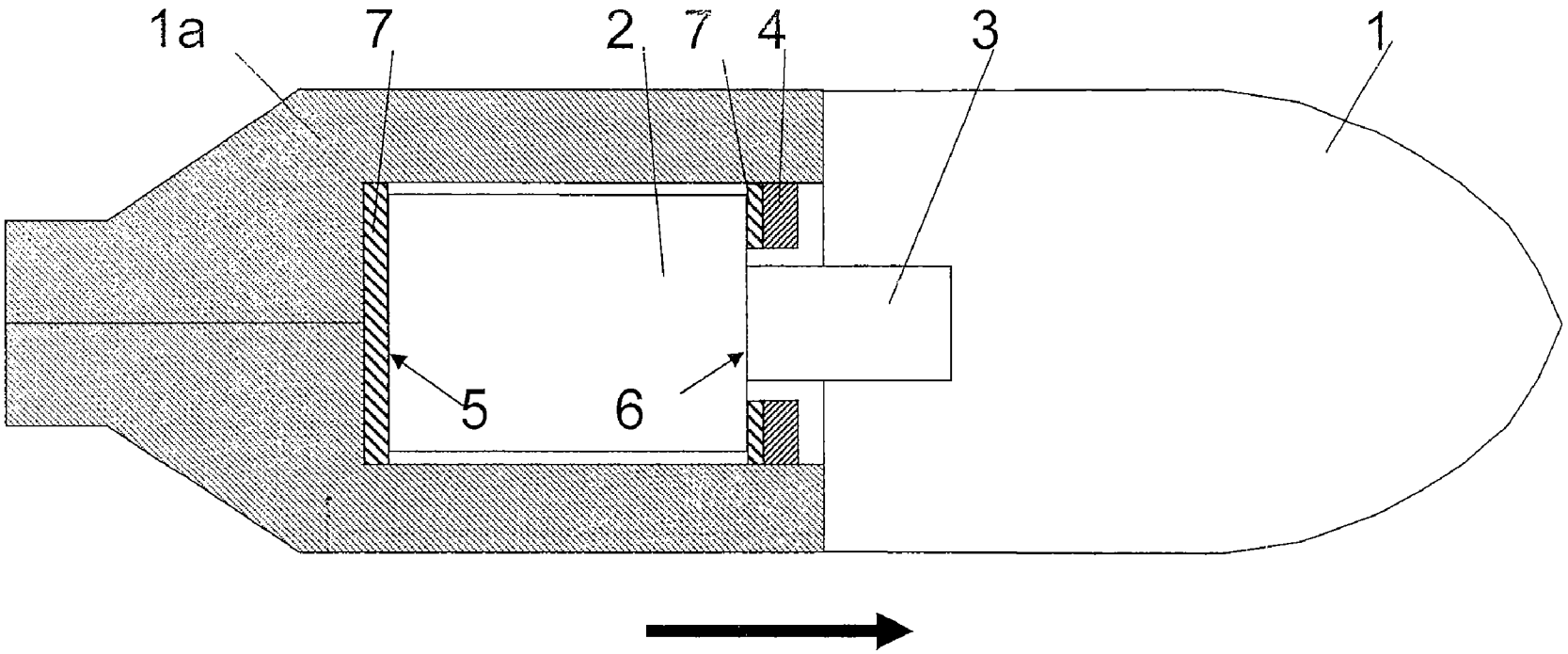
1
3
4
7
2
6
5
7
1a

FIRING DEVICE

This application claims priority from German Patent Application No. 10 2008 057 769.3, filed Nov. 17, 2008, the entire disclosure of which is incorporated herein by reference.

FIELD OF THE INVENTION

The invention relates to a so-called fuze damping in projectiles, in particular with a built-in firing delay.

BACKGROUND OF THE INVENTION

In projectiles having a firing device, whose fuze is intended to still be functional during or after the penetration of targets, the problem arises that the oscillations of the projectile initiated by the impact shock can have a negative influence on, or even destroy, the sensitive components of the firing device. The oscillations, which are transmitted to the firing device, are caused on the one hand by the sudden deceleration of the projectile and on the other hand by shock waves or sound waves that are introduced into the projectile.

In previous practice, the fuze components were therefore hardened and/or encapsulated in order, in this way, to reduce the introduction of oscillations to the firing system. However, in the case of extreme target structures, measures such as these are not sufficient, and the functional reliability of the firing system cannot always be guaranteed, since they are not sufficient to compensate for the oscillations (for example, on building targets), which occur in or on the fuze on penetration.

The purpose of the invention is, therefore, to include a device in the projectile that minimizes the introduction of oscillations into the firing device and, nevertheless, guarantees the functional reliability of the fuze itself.

SUMMARY OF THE INVENTION

The object of the present invention is achieved by the features of a first embodiment, which pertains to a projectile (1) having a rear part (1*a*) and a fuze (2), wherein at least one damping element (7) is inserted between a fuze base (5) and the projectile (1) and/or between a fuze shoulder (6) and a possible threaded ring (4) or similar attachment element. Various other embodiments of the invention are specified according to preferred embodiments as follows.

For example, in accordance with a second embodiment of the present invention, the first embodiment is modified so that that the damping element (7) is in the form of a disc, ring or pot. In accordance with a third embodiment of the present invention, the first embodiment or the second embodiment are modified so that the damping element (7) is a material with a lower acoustic impedance than the material of the projectile (1). In accordance with a fourth embodiment of the present invention, the third embodiment is further modified so that the damping element (7) is a plastic, for example PE.

The invention is based on the idea of including, in the projectile, a damping system or a damping device, comprising damping and decoupling elements, in order to dissipate oscillations from the firing device.

Damping devices in projectiles are known per se. For example, DE 698 14 022 T2 (EP 0 928 948 B1) describes a projectile having multiple charges and having a damping section that is compressed in the longitudinal direction when the projectile is subjected to the launch acceleration. A gap between the damping section and a rigid support apparatus disappears, as a result of which the support apparatus comes into direct contact with the contact surfaces.

DE 60 2004 001 496 T2 relates to an anti-bunker munition, in which a submunition and the apparatus for ejection of the submunition are isolated from at least one of the walls of the internal cavity by means of a damping material.

In contrast, the present invention employs a solution that provides damping and mechanical decoupling of the firing device, which is included in a fixed manner in the projectile, as a result of which peaks on impact are dissipated and can no longer have a destructive effect on the mechanical and electronic components. The additionally included damping device therefore reduces the effects of the projectile oscillations by means of additional materials of low density and with high damping characteristics with respect to both sound waves and shock waves. The damping device, in according to the present invention, decouples the firing device from the mostly metallic structural area in the projectile.

The oscillations are preferably dissipated by a plastic, which is favoured as the damping and decoupling material. The load on all the components of the fuze, of the firing device, and of the firing chain, is thereby reduced, thus ensuring operation even against extreme targets. The fuze function (i.e., delayed fuzing after penetration of the target results in delay-function) is now also possible, guaranteeing the functional reliability of this fuze function.

The materials employed by the present invention are preferably determined with the assistance of computer simulations (for example, ABACUS EXPLICIT from the Simulia Company). Different penetration processes of a projectile, on passing through steel plates, armour plates, brick walls, concrete walls and sand bunkers, etc., are simulated in the simulation computer, with the load spectrum for the projectile/system being determined in this case, on the basis of which the material and the geometry of the fuze damping are designed. Alternatively, however, it is also possible to use empirical values to determine the materials.

In one preferred embodiment of the present invention, discs are inserted in front of and behind the fuze, or the firing device, and these discs are screwed to the firing system with an appropriate torque. A material is selected for the discs so that the optimum damping for the firing system is achieved for all targets with the selected (defined) torque.

The thickness of the discs is, in accordance with the present invention, matched to the load spectra (for example, by simulation), thus allowing optimization of the damping system, in particular, for specific targets.

Since the damping system is composed mainly of a small number of discs, preferably of plastic, the solution provided by the present invention is also highly cost effective. Existing firing systems can be modified without major effort.

Virtually complete packaging of the fuze with the material that absorbs the damping is also possible and technically feasible, in accordance with the present invention.

BRIEF DESCRIPTION OF THE DRAWING(S)

The invention will be explained in more detail using one exemplary embodiment and with reference to the attached drawing, which illustrates a projectile in accordance with the present invention.

DETAILED DESCRIPTION OF THE INVENTION

In the drawing, the single FIGURE shows a projectile 1 with a rear part 1*a* in which a firing system is located comprising a fuze 2 and a firing booster 3 (if provided in the embodiment design). The firing system is held in the projectile 1 by, for example, a threaded ring 4 or an attachment element of some similar type.

At least one damping element 7 is inserted between a fuze base 5 and the projectile 1 and/or between a fuze shoulder 6 and the threaded ring 4. The damping element 7, which is in the form of a disc or ring (or else is U-shaped), is preferably composed of plastic (for example, polyethylene=PE) or of a material with a lower acoustic impedance than the material of the projectile 1. The threaded ring 4 is preferably tightened with a defined torque. In consequence, the damping surfaces of the material of the damping element 7 rest completely on the firing system and no gaps are created. At the same time, it is used to fix the firing system and for its attachment in the projectile 1.

The arrow in the FIGURE indicates the firing direction. When the projectile 1 strikes a target, which is not illustrated in any more detail, the resultant oscillations are absorbed by the damping element or elements 7. The projectile 1 is itself fired with a firing delay, only after the projectile 1 has penetrated through the target, with the residual forces being sufficient to initiate the fuze.

The invention claimed is:

1. A projectile comprising:

(a) a rear part;

(b) a fuze; and (c) at least one damping element inserted between a fuze base and the rear part of the projectile, or between a fuze shoulder and an attachment element, or between the fuze base and the rear part of the projectile and between the fuze shoulder and the attachment element, wherein the fuze is a delayed fuze that is initiated by residual forces when the projectile penetrates a target, and the at least one damping element comprises a material matched to a load spectra of the projectile so that damping by the material is sufficient to absorb axial oscillations resulting from when the projectile strikes the target so that operation of the delayed fuze by residual force initiation is ensured.

2. A projectile according to claim 1, wherein the damping element is selected from the group consisting of a disc, a ring and a pot.

3. A projectile according to claim 2, wherein the damping element comprises a material with a lower acoustic impedance than a material of the projectile.

4. A projectile according to claim 1, wherein the damping element comprises a material with a lower acoustic impedance than a material of the projectile.

5. A projectile according to claim 4, wherein the damping element comprises a plastic.

6. A projectile according to claim 5, wherein the plastic is polyethylene.

7. A projectile according to claim 1, wherein the attachment element is a threaded ring.

8. A projectile according to claim 1, wherein the load spectra of the projectile corresponds to a penetration process of the projectile selected from the group consisting of the projectile passing through a steel plate, the projectile passing through an armor plate, the projectile passing through a brick wall, the projectile passing through a concrete wall, and the projectile passing through a sand bunker.

9. A projectile according to claim 8, wherein the load spectra of the projectile is determined by a simulation computer.

10. A projectile according to claim 8, wherein the at least one damping element comprises two damping elements that include a first damping element and a second damping element, wherein the first damping element is inserted between the fuze base and the rear part of the projectile and second damping element is inserted between the fuze shoulder and the attachment element.

11. A projectile according to claim 1, wherein the load spectra of the projectile corresponds to a penetration process of the projectile selected from the group consisting of the projectile passing through a steel plate, the projectile passing through an armor plate, the projectile passing through a brick wall, the projectile passing through a concrete wall, and the projectile passing through a sand bunker.

12. A projectile according to claim 11, wherein the load spectra of the projectile is determined by a simulation computer.

13. A projectile according to claim 11, wherein the at least one damping element comprises two damping elements that include a first damping element and a second damping element, wherein the first damping element is inserted between the fuze base and the rear part of the projectile and second damping element is inserted between the fuze shoulder and the attachment element.

14. A projectile according to claim 1, wherein the material comprises polyethylene.

15. A projectile according to claim 1, wherein the damping element also mechanically decouples the fuze from the rear part.

16. A projectile according to claim 1, wherein the attachment element holds a damping surface of the at least one damping element completely against the fuze with no gaps.

17. A projectile according to claim 1, wherein thickness of the at least one damping element is matched to the load spectra of the projectile so that the thickness of the material of the at least one damping element is sufficient to absorb axial oscillations resulting from when the projectile strikes the target so that operation of the delayed fuze is ensured.

* * * * *